US011600918B2

(12) United States Patent
Hogeman et al.

(10) Patent No.: US 11,600,918 B2
(45) Date of Patent: Mar. 7, 2023

(54) INTEGRATED ANTENNA ARRANGEMENT

(71) Applicant: THALES NEDERLAND B.V., Hengelo (NL)

(72) Inventors: Edwin Hogeman, Hengelo (NL); Winston Van Oosterhout, Hengelo (NL); Ivo Maatman, Hengelo (NL); Wiegard Jongsma, Hengelo (NL)

(73) Assignee: THALES NEDERLAND B.V., Hengelo (NL)

( * ) Notice: Subject to any disclaimer, the term of this patent is extended or adjusted under 35 U.S.C. 154(b) by 0 days.

(21) Appl. No.: 16/771,554

(22) PCT Filed: Dec. 10, 2018

(86) PCT No.: PCT/EP2018/084152
§ 371 (c)(1),
(2) Date: Jun. 10, 2020

(87) PCT Pub. No.: WO2019/121094
PCT Pub. Date: Jun. 27, 2019

(65) Prior Publication Data

US 2021/0184348 A1 Jun. 17, 2021

(30) Foreign Application Priority Data

Dec. 22, 2017 (EP) ..... 17210545
Mar. 5, 2018 (EP) ..... 18160045

(51) Int. Cl.
*H01Q 3/04* (2006.01)
*H01Q 1/12* (2006.01)
(Continued)

(52) U.S. Cl.
CPC ..... *H01Q 3/04* (2013.01); *H01Q 1/125* (2013.01); *H01Q 1/40* (2013.01); *H01Q 1/405* (2013.01);
(Continued)

(58) Field of Classification Search
CPC ..... H01Q 1/34; H01Q 1/50; H01Q 1/125; H01Q 3/04–10; H01Q 21/28
See application file for complete search history.

(56) References Cited

U.S. PATENT DOCUMENTS 3,739,388 A 6/1973 Callaghan
6,002,374 A * 12/1999 Nicholas ..... H01Q 1/1242 343/725
(Continued)

FOREIGN PATENT DOCUMENTS

CN 103515716 A * 1/2014
CN 103 515 716 B 11/2015
(Continued)

*Primary Examiner* — Andrea Lindgren Baltzell
*Assistant Examiner* — Amal Patel
(74) *Attorney, Agent, or Firm* — BakerHostetler

(57) ABSTRACT

An antenna arrangement includes a directional antenna assembly, the directional antenna assembly comprising a directional antenna intended to be mounted on an interface delimited by a stationary support structure, the directional antenna generally extending according to a main axis perpendicular to the plane defined by the interface, wherein the antenna arrangement further comprises a rotatable base mounted on the interface, the rotatable base comprising a pole integral with the rotatable base, the pole extending in the direction of the main axis, the rotatable base being rotatable about the main axis 11, a rotation of the rotatable base actuating the rotation of the pole about the main axis.

18 Claims, 10 Drawing Sheets

(51) Int. Cl.

| | |
|---|---|
| ***H01Q 1/40*** | (2006.01) |
| ***H01Q 1/50*** | (2006.01) |
| ***H01Q 21/28*** | (2006.01) |
| ***H01Q 3/08*** | (2006.01) |
| *H01Q 1/34* | (2006.01) |

(52) U.S. Cl.
CPC ..... *H01Q 1/50* (2013.01); *H01Q 3/08* (2013.01); *H01Q 21/28* (2013.01); *H01Q 1/34* (2013.01)

(56) References Cited

U.S. PATENT DOCUMENTS

| | | | | |
|---|---|---|---|---|
| 6,366,252 | B1 * | 4/2002 | Terk | H01Q 1/1207 343/725 |
| 2004/0217908 | A1 * | 11/2004 | Zigler | H01Q 19/13 343/757 |
| 2011/0030015 | A1 * | 2/2011 | King | H01Q 21/30 725/68 |
| 2011/0217976 | A1 | 9/2011 | Kaplan et al. | |

FOREIGN PATENT DOCUMENTS

| | | | |
|---|---|---|---|
| CN | 105 071 018 | A | 11/2015 |
| CN | 205 992 586 | U | 3/2017 |
| EP | 2 795 144 | A1 | 10/2014 |
| WO | 94/26001 | A1 | 11/1994 |
| WO | 2013/092520 | A1 | 6/2013 |

* cited by examiner

INTEGRATED ANTENNA ARRANGEMENT

CROSS-REFERENCE TO RELATED APPLICATIONS

This application is a National Stage of International patent application PCT/EP2018/084152, filed on Dec. 10, 2018, which claims priority to foreign European patent application No. EP 17210545.4, filed on Dec. 22, 2017, and European patent application No. EP 18160045.3, filed Mar. 5, 2018, the disclosures of which are incorporated by reference in their entireties.

BACKGROUND

The invention generally relates to radio frequency (RF) antennas and more particularly to integrated antenna arrangement.

Omni-directional antennas are widely used to transmit and/or receive RF energy in omni-directional (i.e. 360°) beam patterns, in many application fields.

The integration of antennas in an existing application system, such as a naval topside arrangement, raises a number of constraints.

In particular, available space in the application system in which the antenna is to be integrated is generally limited. For example, some equipment manufacturers require that the antennas be installed in a top position. This results in a confined space with multiple antennas.

To be able to provide omnidirectional coverage for communication systems operating in the VHF/UHF band, off the shelf omnidirectional antennas or synthetic omnidirectional antennas consisting of an array of antennas can be used for transmit or receive or transmit and receive simultaneously. In either case, there is a need to ensure that the antennas are not blocked by other antennas or structures nor that other antennas are blocked by the omni-directional antennas. Further, for synthetic bearing omnidirectional antennas made of an array of antennas, it is required to support the wide bandwidth in VHF and UHF while at the same time making it possible for other equipments to be installed on top of the array.

When integrating omnidirectional antennas systems into an application system, interference between emission and reception can also appear. Indeed, multiple communication antennas when placed in a confined space often result in a transmitting antenna interfering with the reception by a receiving antenna. To limit occurrence of interferences, it is known to use tuneable analogue filters that require adequate separation between the frequencies used by the two antennas, which reduces the available bandwidth.

While integrating omnidirectional antennas into an existing structure or system, each antenna is further required to maintain its true 360° field of view in azimuth direction and true field of view in elevation direction, without being obstructed or interfered.

Antenna arrangements exist for enabling integration of omnidirectional antennas and directional antennas in confined spaces. However, such antenna arrangements often block antenna apertures and result in interference between antennas transmission/emission, thereby jeopardizing antenna performance and inducing electromagnetic interference.

The number of antennas used in an application system, such as naval topsides, has dramatically increased over the past decades. With such increasing number of antennas, the integration of omnidirectional antennas in an application system without obstruction of the antenna apertures and on a non-interference basis has became a major challenge.

In synthetic omnidirectional antennas using an array of antennas, such as for example distributed communication antennas, the array of antennas (also referred to as "stack of antennas") operates in the entire VHF/UHF band and the antenna are vertically stacked around a support. The synthetic antenna pattern uses inputs from antennas on a limited diameter to provide omnidirectional coverage. It is needed to have a limited diameter for the support while providing access to the equipments that are to be installed above the antenna array (e.g. SATCOM). The limited diameter also hampers adequate support of a directional antenna, when such directional antenna is further used. On the other hand, increasing the diameter of the antenna array would result in an increased number of antennas to prevent incircularity of the synthetic omnidirectional pattern.

In some existing application systems where the omnidirectional antenna system is to be installed, such as for example on-board of naval ships, the topside equipment requires a minimum installation height and has to be as compact and lightweight as possible to ensure that:

- the stability of the application system is not jeopardized,
- signature (RCS, IR, visual, thermal) and fuel consumption are minimal, and
- the speed of the system (e.g. ship speed) is maximized.

For distributed antenna systems, there is a need to place identical antennas with multiple infrastructures and mechanical provisions for installation and interconnection, which results in additional built-in volume, mass and cost.

Also, since antennas are intended to be at the highest point compared to their surroundings, the antenna arrangement itself as well as the neighbouring equipment and personnel are to be protected against lightning without obstructing the free field of view. For example, installation of a separate lightning arrestor in the vicinity of the sensor arrangement to control the lightning attraction point provides protection against lightning but the lightning arrestor is blocking the 360° unobstructed view.

There is accordingly a need for an improved compact integrated antenna arrangement adapted to be integrated in an application system.

SUMMARY

In order to address these and other problems, there is provided an antenna arrangement comprising a directional antenna assembly, the directional antenna assembly comprising a directional antenna intended to be mounted on an interface delimited by a stationary support structure, the directional antenna generally extending according to a main axis perpendicular to the plane defined by said interface. The antenna arrangement further comprises a rotatable base mounted on said interface, said rotatable base comprising a pole integral with said rotatable base, said pole extending in the direction of said main axis, said rotatable base being rotatable about the main axis, a rotation of said rotatable base actuating the rotation of the pole about the main axis.

In an embodiment, the pole may be configured to rotate outside the the field of view of directional antenna.

The antenna arrangement may comprise a rotating control unit for controlling the rotation of the pole.

In an embodiment, the directional antenna may be rotatable at least about a main axis, the rotation of the directional antenna about the main axis defining the azimuth rotation of the directional antenna.

In an embodiment, the upper end of the pole lies above the upper point of the directional antenna assembly.

The antenna arrangement may comprise a communication antenna mounted on the pole.

In an embodiment, the communication antenna may be selected in the group consisting of an omnidirectional antenna and a directional antenna.

In an embodiment, the communication antenna may comprise a set of elementary antennas stacked in the direction of the main axis.

In some embodiments, the directional antenna assembly may comprise a radome in which the directional antenna is enclosed.

The base of the radome may be mounted upon the rotatable base.

Alternatively, the base of the radome may be directly mounted upon the support structure and surrounded by the rotatable base.

In an embodiment, the antenna arrangement may comprise a lightning arrestor arranged on the pole.

There is further provided an antenna system comprising an antenna arrangement according to any of the preceding embodiment, and a hollow support structure mounted on an installation interface of a support system. The support structure may comprise a through hole, the rotatable base delimiting an inner passage communicatively coupled with said through hole of the support structure and with an inner passage of the pole, the inner passage of the pole being communicatively coupled to the inner passage of rotatable base, the antenna arrangement comprising a cable running from a fixation point on the support system to the upper end of the pole, the cable passing through the support structure to the rotatable base via the through hole and said inner passages.

In an embodiment, the cable may be a conductive screened cable.

In an embodiment, the antenna system may comprise a connection component to connect the rotatable base to the support structure, the connection component being arranged at the level of said through hole and enabling the passage of the cable.

In an embodiment, the connection component may be a cable twist.

In an embodiment, the connection component may be a rotary joint.

Embodiments of the invention thus provide a compact integrated antenna arrangement with optimized built-in volume and/or dimensions, at minimum mass/cost.

The antenna arrangement according to some embodiments of the invention further provides a true unobstructed free field of view for any type of antenna system including for example VHF/UHF omnidirectional communication antennas and directional antennas.

Advantageously, electromagnetic isolation is achieved between transmitting and receiving antennas.

The antenna arrangement is adapted to ensure lightning protection of the antenna arrangement and neighbouring equipment and/or personnel without blocking the free field of view.

Further advantages of the present invention will become clear to the skilled person upon examination of the drawings and detailed description. It is intended that any additional advantages be incorporated herein.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, serve to explain the embodiments of the invention.

DETAILED DESCRIPTION

Figure 1:
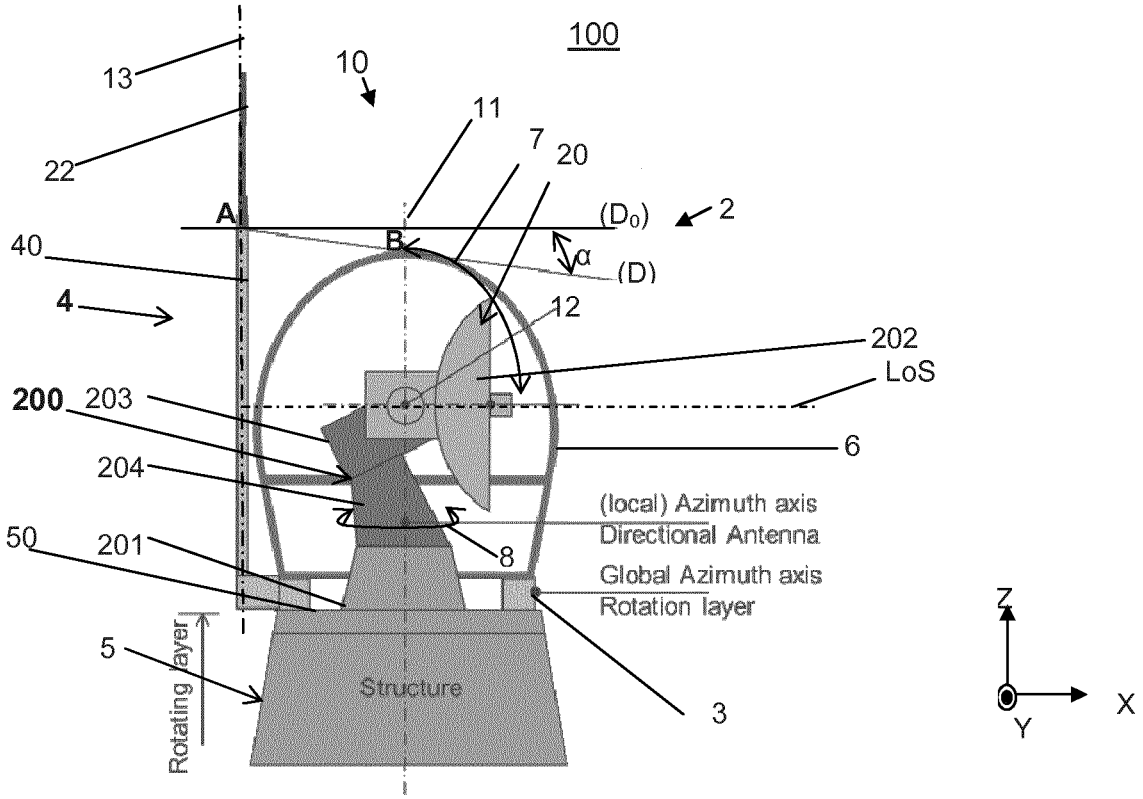
FIG. 1 is a diagrammatic view of an antenna arrangement according to an embodiment.

Referring to FIG. 1, there is shown an exemplary operational system 100 in which an antenna arrangement 10 according to embodiments of the invention can be implemented. The antenna arrangement 10 comprises a directional antenna assembly 2 integrated into an application system 12. The application system 12 may be any system in which the antenna arrangement 10 can to be integrated, such as a ship or a land-based system for compound protection for example.

The directional antenna assembly 2 may comprise at least one directional antenna 20, mounted upon a support structure 5. The support structure 5 may be any support structure generally extending according to a vertical axis 11 and presenting an upper surface forming an interface 50 upon which the directional antenna 20 can be mounted, such as a vertical mast. The vertical mast may be a metallic mast for example. The interface 50 of the support structure 5 delimits a surface upon which at least some of the elements of the directional antenna assembly 2 may be arranged.

Although the invention is not limited to such system, the invention has particular advantages for application systems 12 comprising at least one mast forming a support structure 5, such as for example masts on board of ships, on which the antenna arrangement 10 is to be integrated.

Exemplary masts that can be used include with no limitation Pole masts, Tripod masts, Lattice masts, MACK (Mast-Stack) masts, Enclosed masts, Solid masts. The top of such masts forms an optimal position for an antenna arrangement.

In one application of the invention, the mast 5 may be a hollow structure adapted for arranging several equipments inside such an Integrated Mast, also referred to as an I-Mast. In an I-Mast, the mast and the equipments mounted on and inside the mast may be built and tested separately from the ship, while the ship is under construction. When the ship is ready, the mast may be put on the ship as a turnkey system. It offers a simple interface to the ship's power supply, cooling water supply, combat system, and mechanical deck structure, making installation a plug and play operation.

Applications of the invention includes without limitation radar, and satellite communication to obtain information about or from remote objects.

The directional antenna 20 may be configured to transmit and/or receive spatially concentrated electromagnetic radiation in one direction at a time to detect and/or track objects in the environment of the system, such as for example objects between the waves if the application system 12 is a ship.

The directional antenna 20 may be rotatable in azimuth, about the main axis 11.

According to one embodiment of the invention, the antenna arrangement 10 further comprises a pole arrangement 4 comprising at least a rotatable pole 40 (also referred to as "pole mast" or "pole assembly"), the pole 40 being rotatable about the main axis 11 (in azimuth). The pole 40 may be configured to protect the topside structure of the antenna arrangement against lightning and/or support a communication antenna 22 mounted on it. The communication antenna 22 may be an omnidirectional or a directional antenna.

The antenna arrangement 10 may further comprise a rotatable base 3 (also referred to hereinafter as rotatable or rotating layer) for controlling the rotation of the pole assembly 4 in azimuth, about the main axis 11, externally to the directional antenna assembly 2.

The rotatable base 3 for rotating the pole may be mechanically connected to at least one bearing of the directional antenna. The rotating part may be mechanically supported on the stationary part by means of a bearing. The pole 40 may be mounted on the rotatable base 3, the rotation of the rotatable base 3 controlling the rotation of the pole 40 about the axis 11, so as to enable relocation of the pole 40, outside the line-of-sight of the directional antenna 20.

The azimuth position of the directional antenna 20 may be obtained from position data of the directional antenna 20, if available, or via position sensors, such as proximity switches or encoders, which are configured to detect the position of the directional antenna. In some embodiments, the sensors may comprise a sensor in the bearing that detects when a defined zero position is passed.

The directional antenna may be steered to point at a selected direction for tracking an object or for surveillance in that direction or Line-of-Sight communication. The position of the sensors may be known by the system 100.

Based on azimuth position of the directional antenna 20, the rotation of the pole assembly 4, and thus of the communication antenna 22 when such an antenna is used, may be adjusted (i.e. rotated) outside the free field of view of the directional antenna 20. The pole 40 is thus mechanically slaved to the rotation of the directional antenna 20.

The rotation of the rotatable base 3 may be adjusted by use of at least actuator (e.g. motor, cylinder) which can be complemented in some embodiments by one or more transmission elements (such as a gear, a belt, wheels etc.).

In one embodiment, the actuators and possible transmission equipments of the rotatable base 3 may be arranged inside the support structure 5.

In some embodiments, the rotation of the rotatable base 3 may be controlled to have a discontinuous rotation depending on the environment of the antenna arrangement 10 and/or on the target of the antenna system 100.

The rotatable base 3 forms a self contained layer which comprises an interface with the support structure 5, an interface with the pole assembly 4. In some embodiments, it may comprise an interface with the directional antenna assembly 2.

Figure 5:
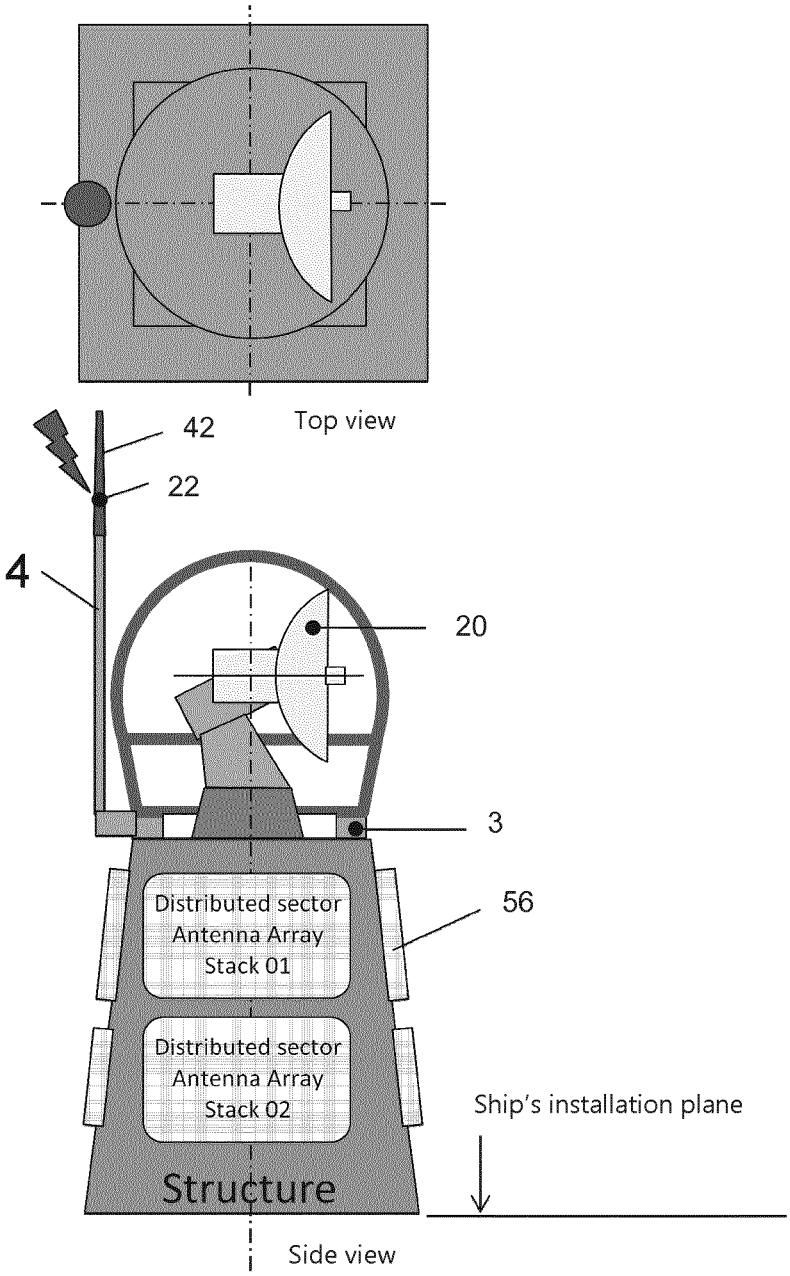
FIG. 5 is a diagrammatic view of an antenna arrangement with lightning protection, according to an embodiment.

The communication antenna 22 may be mounted on the pole 40 at a fixation point noted "A". The tangent to the radome 6 passing through the fixation point A is noted (D). The intersection point between (D) and the radome 6 is noted B. In FIG. 5, B coincides for example to the upper point of the radome 6.

The angle $\alpha$ is defined as the angle between:

- the tangent (D) to the radome 6, passing through the fixation point A, and
- the line ($D_0$) passing through point A which is parallel to the X-axis.

The angle $\alpha$ may be defined or selected to accommodate the movement of the system in which the support structure 5 is arranged if such system (for example ship) moves.

In some embodiments, the height of the rotatable base 3 may be predefined to be as small as possible. In one embodiment, the height of the pole may be such that the bottom A of the omnidirectional communication antenna 22 on top of the pole is above the top B of the radome 6.

In a preferred embodiment of the invention, the antenna 10 may form a surveillance or tracking system, the directional antenna assembly 2 forming a radar system transmitting a Radio Frequency (RF) beam in a transmission direction, while the pole 40 may be positioned above the top of the radar system 20 which transmits the RF beam in the transmission direction, so that the pole does not impede the correct operation of the radar system 20. In such embodiment, the directional antenna assembly 2 may form a rotating surveillance radar, a fixed four face phased array radar, a rotatable one face phased array radar, or a Fire Control Radar radar used for fire control for example. The omnidirectional antenna 22 may have a free view so it should be above the radome 6.

In one embodiment, the angle $\alpha$ should be such that the bottom of the lowest Radio Frequency bundle transmitted by the communication antenna 22:

- is not blocked by the top of the radome 6 in embodiments where a radome 6 is used, or
- is not blocked by the top of the directional antenna assembly 2 in embodiments where no radome 6 is used.

The angle $\alpha$ may be pre-calculated per specific communication system before installation.

Depending on the application of the invention, the support structure 5 (e.g. mast) may be fixedly mounted on an installation plane of the application system 12 (e.g. ship) and be integral with it. Accordingly, if the application system 12 moves, the support structure 5 undergoes the same movement. The support structure 5 is thus stationary with respect to the application system. As used herein, the "rotating part" of the antenna arrangement 10 with respect to the stationary support structure 5 refers to rotating elements which rotate about the main axis 11, that is:

the pole 40 (and possibly the communication antenna 22 and/or lightning protection if such communication antenna or lightning protection is mounted on the pole), the rotatable base 3.

The rotatable part may further include the directional antenna 20 if it is rotatable about the main axis 11.

Such rotatable elements of the antenna arrangement 10 may be rotated at least about the main axis 11, while the support structure 5 remains fixed with respect to the application system 12 (e.g. ship).

In some embodiments, the antenna arrangement 10 may further comprise a radome 6 connected to the support structure 5. The radome 6 delimits an enclosure in which the directional antenna 22 may be arranged. The radome 6 may form a structural enclosure configured to protect the directional antenna 20. The radome 6 may have any form and may be made of any material compatible with the operation of the antenna. In particular, the radome 6 may be configured so that its dimensions allow the free movement of the directional antenna in the enclosure. The radome 6 may further be weatherproof and may be made of a material that attenuates the electromagnetic signal transmitted or received by the directional antenna 20. The material of the radome 6 may be further configured to conceal the antenna electronic equipment from public view. The radome 6 may be of any shape and size depending on the application of the invention. In the embodiments shown in FIG. 1, the radome 6 comprises a dome-like cover.

Although the use of a radome 6 may present advantages for some applications of the invention, the skilled person will readily understand that the invention is not limited to the use of such radome and that the invention may also apply to electro optical system 2 deprived of a radome or enclosure. However, to facilitate the understanding of the invention, the following description of some embodiments of the invention will be made mainly with reference to an antenna arrangement 10 comprising a radome 6, for illustration purpose only.

The directional antenna 20 (also referred to as a beam antenna) may be configured to radiate and/or receive power in specific directions. The antenna's beam width may be less than 360 degrees, and preferably as narrow as possible. Although the figures represents a directional antenna of the type dish antenna, the skilled person will readily understand that the invention is not limited to such types of directional antennas and may apply to other types of directional antennas such as a Dish antenna, a Flat antenna, a Patch antenna, a horn antenna, a slotted waveguide antenna or Active Electronically Scanned Array (AESA), etc. The following description of some embodiments of the invention will be made with reference to a directional antenna 20 of dish antenna type for illustrative purpose only.

The steering range of the directional antenna 20 may be full hemispheric or limited to a narrower region.

The directional antenna 20 may be rotatable in azimuth and/or elevation.

To steer (or point), the directional antenna 20 may be configured to rotate about at least one axis. The axes defining the rotation of the directional antenna 20 may comprise an elevation axis and a local azimuth axis 12. The azimuth axis is vertical as rotating around it changes the azimuth (usually the Z-axis). The azimuth axis coincides with the main axis 11. The local elevation axis 12 shown in FIG. 1 is the Y-axis as rotating around this axis changes the elevation.

In the following description, reference Cartesian (or rectangular) coordinates (X,Y,Z) will be used, with the antenna system being located at (0, 0, 0), the Y axis designating the elevation axis 12, the Z axis designating the azimuth axis 11, and the X axis designating the axis that is perpendicular to the Y and Z axis, defined by the outer product of Y and Z (Y×Z). The horizontal plane is defined by the axes X and Y. Reference 7 depicts elevation steering of the antenna 20 and reference 8 depicts azimuth steering of the antenna 20.

In FIG. 1, the X-Y plane represents the azimuth plane. The elevation plane is then the Z-X plane orthogonal to the azimuth plane. Although, in the figures, the antenna patterns (azimuth and elevation plane patterns) are represented in Cartesian coordinates, it should be noted that he antenna patterns may be also represented as plots in polar coordinates.

In the embodiment of FIG. 1, the vertical axis 11 (which may be also referred to hereinafter as "rotation" axis) coincides with the axis Z of the directional antenna 20 and is perpendicular to the connection interface 50 of the support structure 5.

In the example of FIG. 1, the line of sight 13 of the directional antenna coincides with the X axis in the referential (X, Y, Z).

The directional antenna 20 may be preferably as compact as possible with a minimize size of the driving motors, and minimal mass, and volume while being adapted for the system 12 and the application of the invention. The required radar performance may define the dimensioning of the antenna etc.

The directional antenna 20 may be mounted upon the support structure 5 by means of a connection assembly 200 in some embodiments. The connection assembly 200 may be configured to rotate the antenna in azimuth and/or elevation during the operation of the directional antenna 20. The directional antenna 20 may be mounted upon the support structure 5 through a connection base 201.

In embodiments where the directional antenna 20 is a dish-like antenna, the directional antenna may comprise a dish 202 mounted on an arm 203 which is rotatably connected to a rod 204 via a pivot (not shown). The axis of the pivot is the axis 12. The rod 204 may be pivotally attached at its end, which is remote from the end connected to the pivot connection, to the connection base 201. The directional antenna 20 may be set up by adjusting the direction of the rod 204 and the direction of the arm 203. It should be noted that FIG. 1 is a schematic representation of a radar system showing a particular layout. However, the skilled person will readily understand that other different layouts can be used.

The directional antenna 20 may further comprise one or more actuators such as driving motors (not shown in FIG. 1) for actuating the rotation of the directional antenna about the elevation and azimuth axes. The motors may thus enable positioning the antenna and changing the azimuth or/and elevation or/and polarization of the antenna main beam.

In one embodiment, the actuators of the directional antenna 20 may be arranged inside the support structure 5.

The connection base 201 of the directional antenna 20 may be connected to the lower end of directional antenna 20 (represented, in FIG. 1, by the lower end of the rod 204).

The rotatable base 3 may be configured to rotate according the vertical axis 11 with respect to the support structure 5.

The pole 40 may extend according to an axis 13, the axis 13 being advantageously substantially vertical and parallel to the axis 11.

In one embodiment, the pole 40 of the pole assembly 4 may form an auxiliary support for supporting a communication antenna 22.

The rotatable base 3 forms a mechanical rotating platform configured to enable installation of the communication antenna 22, while ensuring free field of view above the directional antenna 20.

The rotatable base 3 may be configured to actuate the rotation of the pole 40, possibly surmounted with a communication antenna 22, about the main axis 11. Accordingly, the position of the pole 40 may be rotated about the axis 11, the position of the pole 40 thus describing an arc of a circle in the X-Y plane, having a radius R equal to the distance between the axis 13 and the vertical axis 11.

Advantageously, the pole 40 may be placed in the antenna arrangement 10 such that the pole 40 (possibly surmounted with the communication antenna 22 and/or lightning protection) does not collide with an element of the directional antenna assembly 2, this element of the directional antenna assembly 2 being:

- the directional antenna 22 itself, in embodiments where no radome or enclosure is used to protect the directional antenna, or
- the radome 6 encompassing the directional antenna 3, in embodiments using such radome.

In one embodiment, the antenna arrangement 10 may comprise a control unit for controlling the rotation of the pole 40 and of the directional antenna 20 about the main axis 11 (and so the operation of the actuators controlling the rotation of the pole 40 and of the directional antenna 20) so as to avoid collision between the pole 40 and the directional antenna assembly 2. The input of the control unit may be the azimuth position of the directional antenna as set by the system. The control unit may be configured to calculate the shortest route from the current position (from the previous control) to the new position. The control unit may accordingly calculate a position for the pole outside the free view of the directional antenna.

In another embodiment, the distance between the pole 40 and the antenna assembly 2 may be predefined to avoid collision between the pole 40 and the directional antenna assembly 2 whatever the rotational movement of the pole 40 and of the directional antenna assembly 2, while being as minimal as possible to optimize the compactness of the antenna arrangement. In one embodiment, this distance may be advantageously minimal such that rotation is possible.

Further, the position of the pole 40 may be varied according to an arc of circle of radius R from an initial position, the length of the arc of circle being predefined to ensure that the pole 40 remains outside the line-of-sight of the radar transmitting a RF beam in the transmission direction.

Embodiments of the invention thus provide a true unobstructed free field of view (FOV) using at least one pole 40 and a directional antenna 20. As used herein, the FOV refers to the angular cone perceivable by the directional antenna 20 at a particular time instant.

Embodiments of the invention offer a compact solution for integrating an antenna arrangement 10 upon a support structure 50. As a result, the outer surface of the structure support 5 is freed and can be used for possible installation of additional equipments such as additional sensors, while in the prior art such surface is used to arrange communication antennas on specific mounted yardarms.

Embodiments of the invention further allow electromagnetic isolation between a transmitting antenna 20 and a receiving antenna 22, in embodiments where the directional antenna 20 is used for the transmission while an omnidirectional antenna 22 is mounted on the pole 40.

Embodiments of the invention make it possible to install the antenna arrangement 10, possibly surmounted with a communication antenna 22 and with a directional antenna 20 mounted upon the support structure, at minimum mass and costs.

This makes it further possible to access the directional antenna 20 via inside the support structure 5 if the support structure is a hollow structure such as a mast structure.

In a preferred embodiment, as shown in FIG. 1, the upper end of the pole A may lie above the upper point of the directional antenna assembly B (above the radome 6 or above the directional antenna 20 if no radome is used).

In some embodiments, a communication antenna 22 may be mounted on the pole 40, the communication antenna forming a wireless transmitting or receiving antenna that radiates or intercepts radio-frequency (RF) electromagnetic fields.

The communication antenna 22 may be a directional antenna that transmits or receive beams in a transmission or reception direction or an omnidirectional antenna configured to transmit or emit substantially equally in all horizontal directions in a flat, two-dimensional (2D) geometric plane. In the embodiments depicted in the figures, the communication antenna 22 is an omnidirectional antenna. The omnidirectional antenna 22 and/or the directional antenna 20 may be part of independent operating systems, such as communications, radar or Electro Optical systems. The omnidirectional antenna 22 and the directional antenna 20 may be both used to transmit and receive simultaneously. The following description will be made with reference to a communication antenna 22 of omnidirectional type for illustration purpose only.

The omnidirectional antenna 22 may enclose a set of elementary antennas stacked in a vertical direction (according to vertical axis 11), to increase electromagnetic isolation between transmitting and receiving antennas.

The omnidirectional antenna 22 may be a vertically oriented, straight antenna generally extending along a vertical axis (Z-axis corresponding to the elevation axis 11), such as for example a dipole or collinear antenna having a vertical axis substantially coinciding with the pole axis 13 and with the elevation axis 11 of the directional antenna 20 (Z-axis). The omnidirectional antenna 22 may be configured to radiate substantially equal radio power in all azimuthal directions perpendicular to the antenna. Although the figures show an omnidirectional antenna formed by a vertically oriented, straight antenna, the skilled person will readily understand that other types of omnidirectional or communication antennas 22 generally extending in a vertical direction may be used alternatively.

The communication antenna 22 may be advantageously installed with its extremity protruding above the directional antenna 20 to ensure an unobstructed view of the omnidirectional antenna.

Figure 2:
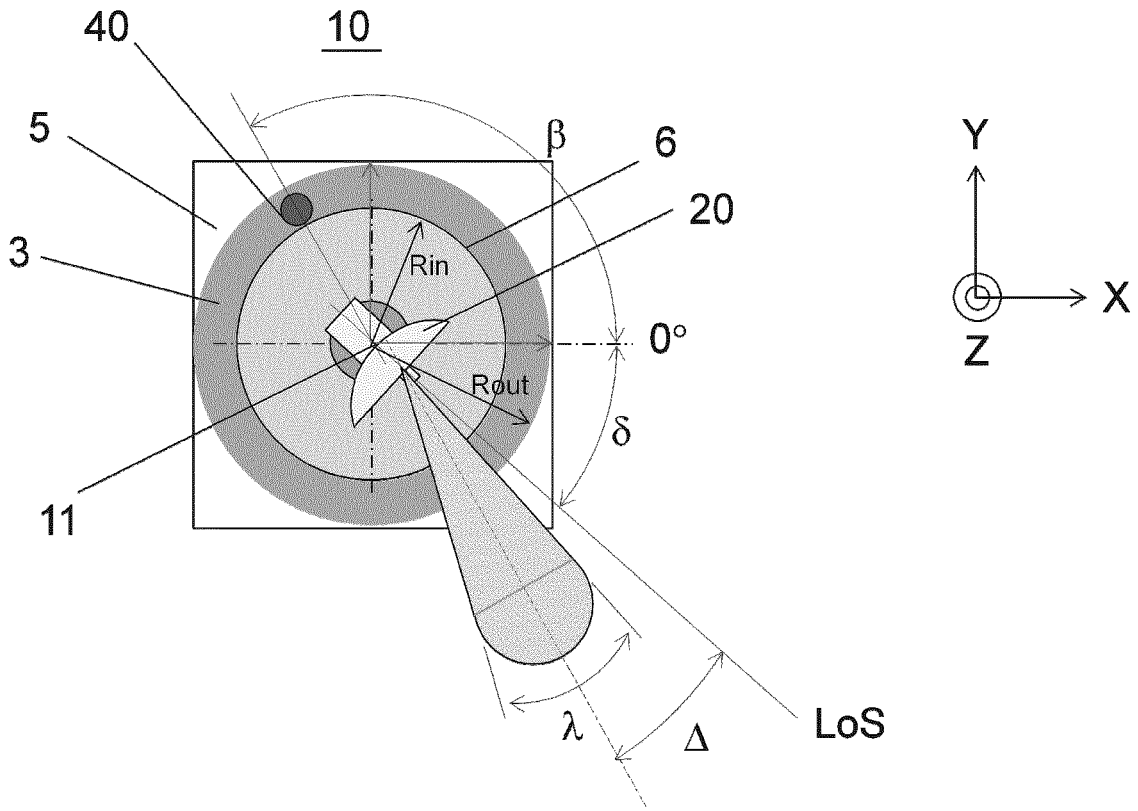
FIG. 2 is a top view of an antenna arrangement according to an embodiment.

FIG. 2 is a top view of the antenna arrangement, according to some embodiments.

The pole 40 is rotationally interdependent with the rotatable base 3 such that a rotation of the rotatable base 3 may trigger the rotation of the pole 40. The rotatable base 3 may form an annular layer having an inner radius $R_{in}$ and an outer radius $R_{out}$. In a cross-section view, the rotatable base 3 may surround the connection base 201 of the directional antenna assembly 2, the rotatable base and the connection base 201 being both centered at the vertical axis 11.

In FIG. 2, the pole is rotating of an angle $-\beta$ ($\beta>45$ degrees in the example shown) with respect to axis X (corresponding to an angle of 0°), while the line of Sight of the directional antenna 20 is rotated of an angle $\delta$ with respect to the axis X ($\delta<45$ degrees in the example shown).

This ensures that the pole 40 and the communication antenna 22 possibly mounted upon the pole do not obstruct the Free Field of View of the directional antenna 20 and create no interferences.

In some embodiments, the system may define the azimuth position of the directional antenna 20. At the same time, the system may steer the pole 40 outside the free field of view of the directional antenna for example by steering the pole to a position defined by the azimuth direction of the directional antenna plus 180°. Accordingly, if for example the azimuth position equals 45°, then the steering position of the pole will be 225°. It should be noted however that to be outside the free field of view of the directional antenna, the 180° angle is not required. More generally, the steering position of the pole 40 can be the azimuth position of the directional antenna plus or minus the beam width of the transmitted RF beam by the directional antenna.

By adjustment of the rotation of the rotatable base 3, the communication antenna 22 can be kept out of the free field of view of the directional antenna 20 (which may be for example a satellite communication antenna or radar antenna), thereby ensuring unobstructed view of the directional antenna 22.

In some embodiments, the radome 6 may be mounted on the rotating layer 3, as shown in FIG. 1. In such embodiment, the directional antenna 20 rotates within the space encompassed by the radome 6, the rotation of the directional antenna 20 being actuated by the rotatable base 3 connected thereto.

In such embodiments, the rotatable layer 3 may be arranged between the base of the radome 6 and the connection interface 50 of the support structure 5, in the vertical plane ZX, while surrounding the connection base 201 in a cross section plan. In such embodiments, the height of the connection base 201 (in the X-Z plane) may be advantageously superior or equal to the height of the rotatable base 3.

Alternatively, the radome 6 may be mounted to the support structure 5 before the rotating layer. Accordingly, in such embodiment, the radome 6 is an element of the rotating part of the antenna arrangement 10.

In such embodiment, the rotating base 3 may be arranged upon the support structure 5 as depicted in FIGS. 1 and 2.

Figure 3:
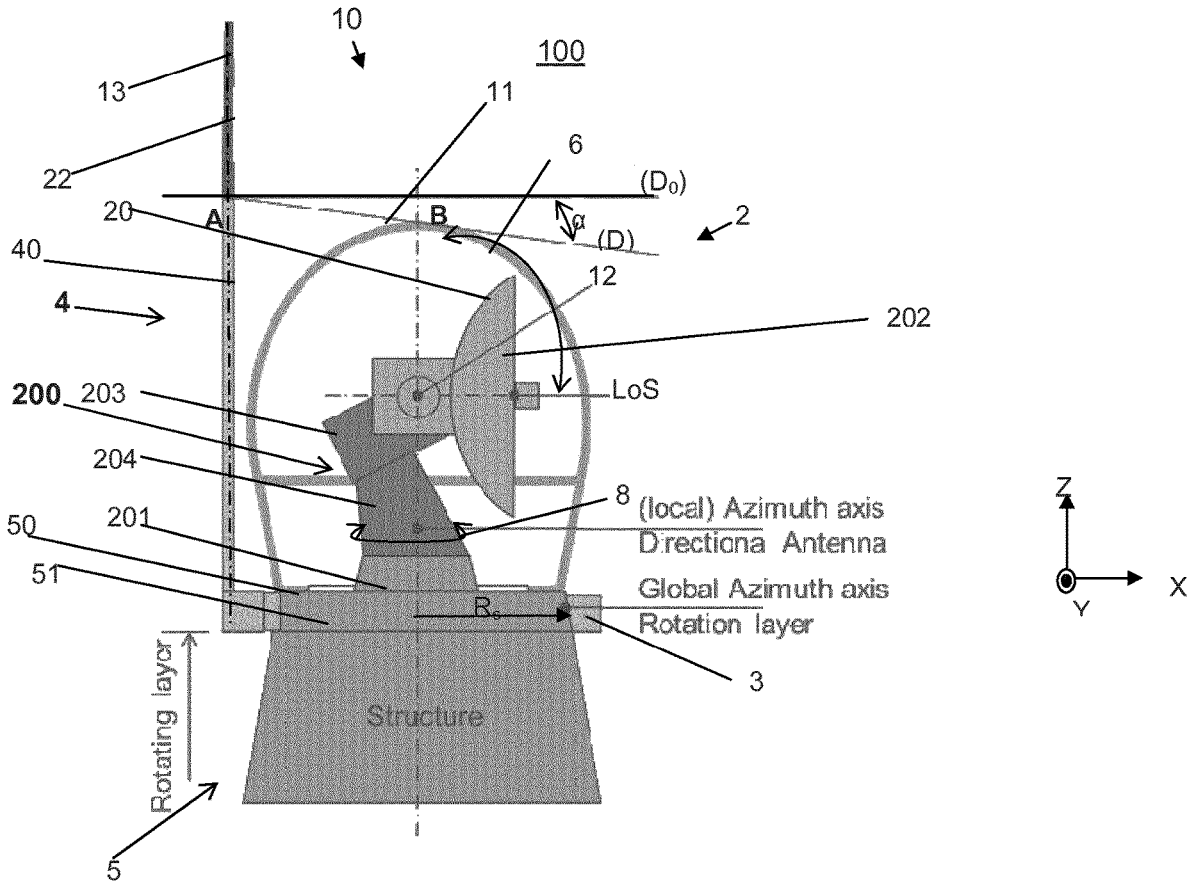
FIG. 3 is a diagrammatic view of an antenna arrangement according to another embodiment, with mounting of the radome upon the rotatable base.

FIG. 3 represents an antenna arrangement 10 comprising a radome 6 directly mounted upon the support structure 5 before the rotatable base 3 (on the interface 50).

In such embodiment, the radome 6 is fixed with respect the support structure 5 (and hence is an element of the stationary part of the antenna arrangement 10).

In some embodiments, the rotating base 3 may be positioned below the connection interface 50 of the support structure 5 and arranged about the support structure 5 as shown in FIG. 3.

In FIG. 3, the rotating base 3 is directly arranged below the connection interface 50 of the support structure 5, about the support structure 5, according to one embodiment. In the embodiment of FIG. 3, the support structure 5 comprises an upper part 51 of fixed radius $R_s$, the inner radius $R_{in}$ of the rotating base 3 being substantially equal to the fixed radius, the rotating base 3 being mounted about the upper part 51.

Although FIG. 3 shows an arrangement about a top part of support structure 5, in alternative embodiments, the rotatable base 3 may be rotatably mounted about the support structure at another vertical position such as about a middle or bottom part of the support structure 5.

The skilled person will readily understand that the rotating base 3 may have different configurations. For example, the rotating layer may be a linear movable layer. Alternatively, the rotating layer may be connected to the structure or the ship installation.

Figure 4:
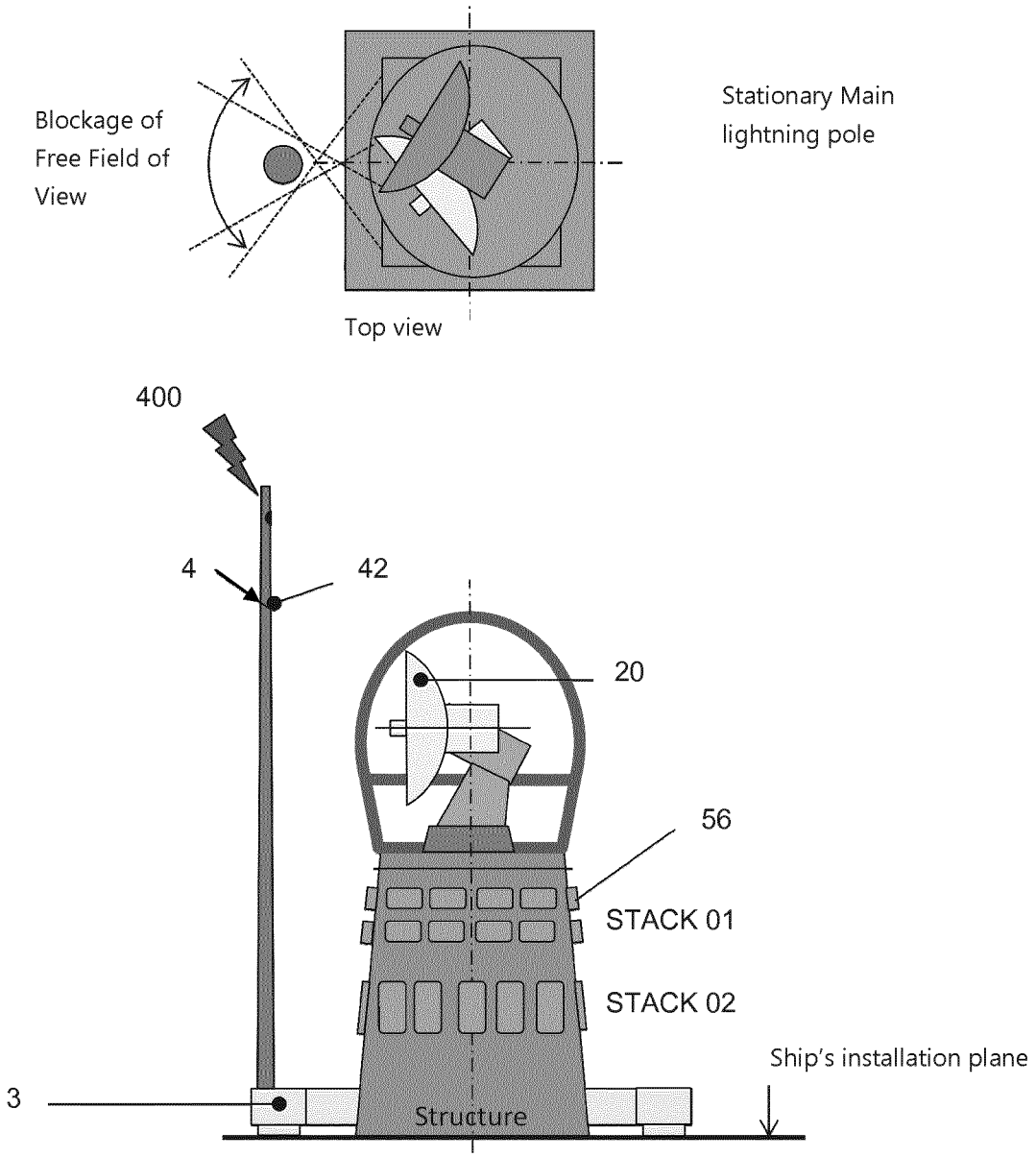
FIG. 4 is a diagrammatic view of an antenna arrangement with lightning protection in which the radome is directly mounted upon the support structure equipped, according to the prior art.

FIG. 4 accordingly represents an antenna system 100 in which the rotatable base 3 is directly arranged on the system installation plane below the support structure 5, according to another embodiment. For example, if the support structure 5 is a mast, the rotatable base 3 may be mounted at or below the ship installation plane 120 while surrounding the mast.

In some embodiments, as shown in FIG. 4, the pole 4 may be used to protect the antenna system against lightning 400. In such embodiment, the pole assembly 4 comprises a lightning arrestor 42 mounted upon the pole 40. The lightning arrestor 42 is configured to protect the directional antenna 20 against lightning near strikes (or other corona or static discharges) that might cause the antenna 20 to act as a "sponge" to the lightning energy and to conduct the high voltage to other electronic components of the antenna system 100. In some embodiments, the lightning arrestor 42 may comprise high voltage-capable capacitors such as high pass filters configured to cancel the frequency and the direct current energy associated with the lightning. The lightning arrestor 42 may be mounted on the pole 40 via connectors. In an embodiment, a preloaded bearing may be used, the arrestor being connected to the bearing so that a high current goes from the arrestor through the bearing (as described for example in EP 2795144 A1).

In some embodiments, the rotatable pole 4 may be both used to support a communication antenna 22 and a lightning arrestor.

FIG. 5 represents an antenna system 100 comprising a pole 4 supporting a communication antenna 22 which itself comprises a lightning arrestor 40, according to an embodiment. The communication antenna 22 may be for example an omnidirectional antenna of UHF (Ultra High Frequency) or VHF (Very High Frequency) type.

In such embodiment, the communication antenna 22 is the main lightning attraction point. The communication antenna 22 can advantageously handle direct lightning hit by use of the lightning arrestor 42. The arrestor 42 may be arranged on the top above the communication antenna 22, such that the arrestor 42 attracts the lightning.

The antenna system 100 may further include further electrical guidance equipments, such as conductive screened cables, for conducting high lightning currents due to a direct lightning hit outside the antenna system.

This provides efficient lightning protection of the antenna system 100 and of the neighbouring equipments and persons, while maintaining an unobstructed field of view for the directional antenna. The rotation of the pole 40 further guaranties an unobstructed view. The pole 40 may be accommodated with different systems to enable different and combined applications.

In some embodiments, the surface of the support structure 5 may be used to arrange one or more additional antenna array stacks 56 such as distributed sector antenna array stacks of UHF/VHF type for additional coverage (for example fixed face AESA in different RF-bands for radar applications or EO-sensors or audio receivers or lasers).

Each stack may have a general ring shape centered about the main axis 11, the distance between the stacks in a vertical direction being predefined.

Figure 6:
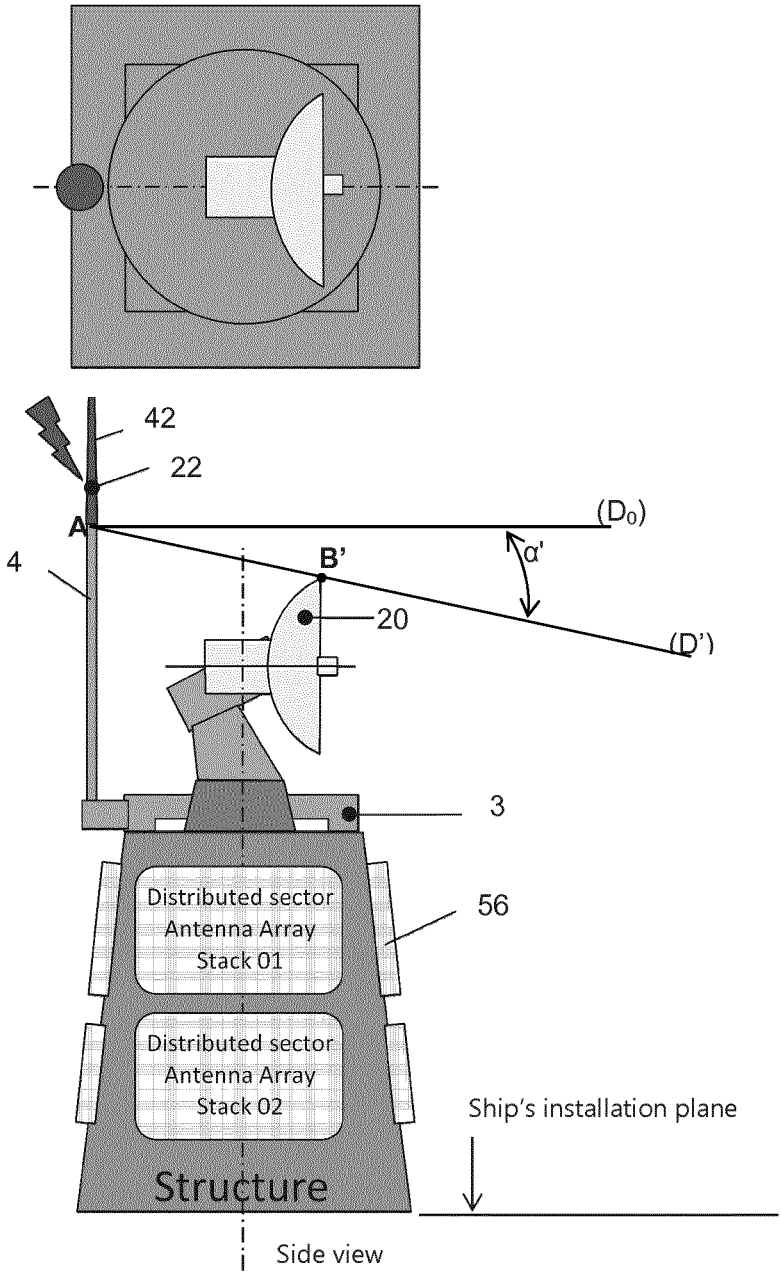
FIG. 6 is a diagrammatic view of an antenna arrangement according to still another embodiment, with a rotating communication antenna and lightning protection upon the pole.

FIG. 6 depicts another embodiment, in which no radome or enclosure is used. In such embodiment, the angle α' may be defined between:

the line (D') passing through the fixation point A and the upper end B' of the directional antenna 20, and the line passing ($D_0$) through point A which is parallel to the X-axis.

In such embodiment, the angle α' may be defined to accommodate the movement of the system in which the support structure is arranged if such system is mobile (for example ship).

Figure 7:
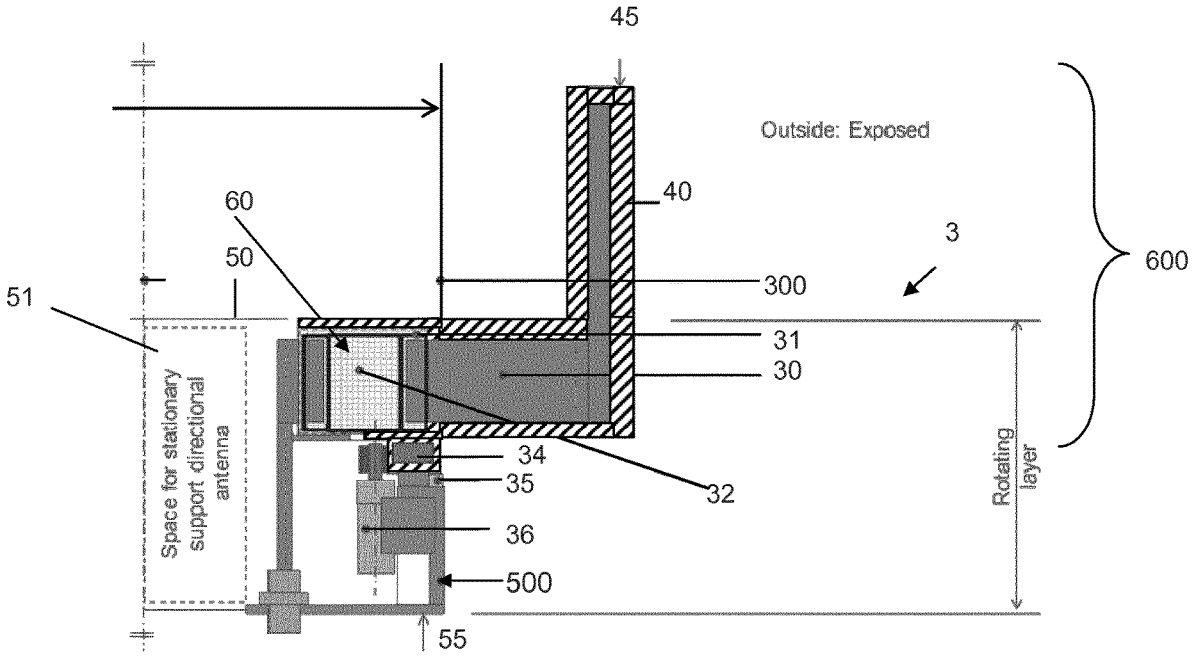
FIG. 7 is a cross section view showing the connection between the rotating part and the stationary part of the antenna arrangement, according to one embodiment.

FIG. 7 is a cross section view showing the connection between the rotatable base 3 and the stationary support structure 5, according to some embodiments.

As shown, the rotating part generally designated by reference 600 comprises the pole 40 and the rotatable base 3, which are integral and can be rotated about the rotation axis 11. The elements of the rotating part 600 are represented by hashed lines.

The stationary part generally designated by reference 500 comprises the support structure 5 (e.g. mast) which is stationary with respect to the system 12 (e.g. ship) on which it is mounted through the interface 55.

The communication antenna 22 and/or the lightning arrestor 42 may be installed on the rotating part 600 through the pole 40 while connection base 201 (pedestal) of the directional antenna 22 is installed on the stationary part 500. The radome 6 of the directional antenna assembly 2 may be installed on the rotatable part or directly on the upper interface of the support structure 50 on the interface 50 before the rotatable base 3.

Advantageously, the stationary and rotatable parts 600 and 500 may have a hollow configuration which delimits an inner space. This inner space may be used, at least partially, to arrange a connection cable 30 for connecting the two parts 600 and 500 while allowing the rotation of the rotatable part 600 and at least one actuator for controlling the actuating of the rotation of the rotatable part 600 and other equipments related to the operation of the rotatable part 600. The inner space of the support structure 5 (e.g. mast) may further comprise additional space 51 for integrating electronics and/or mechanics equipments related to the operation of the directional antenna assembly 2, such as one or more actuator for controlling actuation of the directional antenna 20. Depending on the size of the support structure 5, additional electronics and/or mechanics equipments may be integrated for use by the support system 12 (e.g. ship). The area 51 in FIG. 7 designates the space provided stationary support of the directional antenna 20.

The inner space of the rotatable base 3 and the inner space of the pole 40 may both form a passage, the passage of the rotatable base 3 communicating with the passage of the pole 40 to enable passage of the cable 30.

The cable 30 may run from a fixation point 301 arranged on the support structure interface 55 to the upper interface 45 of the pole 40 (on which an antenna 20 or a lightning arrestor may be fixed), throughout the communicatively coupled passages of the rotatable base 3 and of the pole 40. The cable may be configured to have sufficient travel to enable sufficient rotation movement of the rotating part 600, when the rotatable part 600 rotates relative to the support structure 5.

The cable 30 may be a cable run configured to easily enable a rotation in between the rotatable part 600 (rotatable base 3 and pole 40) and the support structure 5 of a predefined angle, such as for example 540 degrees.

In embodiments where the rotatable base 3 has an annular form about the rotation axis 11, the passage formed in the inner space of the rotatable base 3 may describe an arc of circle of a predefined angle.

The cable 30 may further comprise a connection component 32 for connecting the stationary part 500 to the rotatable part 600, in the connection zone 60, while allowing the passage of the cable 30 between the two parts 500 and 600. The connection component 32 thus allows rotating the platform within predefined travelling limits.

In one embodiment, the connection component 32 may comprise a cable twist, at the connection zone 60 between the stationary support structure 5 and the rotatable base 3 and a cable guide 31 for guiding the cable twist.

The connection between the stationary part 500 and the rotating part 600 can be made using standard off the shelf components such as cable twist solutions which are available of arbitrary length cables or rotary joints.

The cable twist arrangement (31, 32) may be configured to interconnect the stationary part 5 (e.g. mast) and the rotatable base 3 of the rotating part. The cable twist based connection component 32 may be configured to receive at one end the untwisted cable 30 after traversal of the stationary part 500 and transmit the cable at the other end to the rotating part 600 in an untwisted form, the cable being twisted inside the connection component 32. The cable twist 32 may use different twist schemes.

In some embodiments, the cable 30 may be a conductive screened cable configured to direct lightning currents that might hit the communication antenna 22 and/or the pole 4 outside the antenna system.

Such antenna arrangement 10 is advantageously adapted for various dimensions or diameters of the support structure 5.

In an alternative embodiment, the connection component 32 may comprise a hollow rotary joint (also referred to as a rotary union) instead of the cable twist 32. Such rotary joint may comprise two bodies to connect the stationary part 500 to the rotatable part 600 while providing sliding contact channels to provide the interconnection between the stationary part 500 and rotating part 600. The rotary joint may be further selected depending on the environmental conditions (temperatures, pressures, rotation speed, etc.) of the antenna system 100.

The antenna arrangement 10 may further comprise at least one bearing 34 configured to mechanically support the rotating part 600 on the stationary part 500. Each bearing 34 may comprise at least one inner race, one outer race and a plurality of rolling elements, such bearing components being loaded by loading means arranged in such a manner that a direct electrical connection exists between these components to ensure protection against high voltage transients, as described in EP 2795144 A1.

The stationary part 500 may further comprise the bearing 34, a seal element 35 arranged between the stationary part 500 and the rotating part 600, and an actuator 36 configured to actuate the rotation of the rotating part 600.

The support structure 5 may comprise a seal to protect the equipments arranged inside the support structure from the effect of the weather environment.

Figure 8:
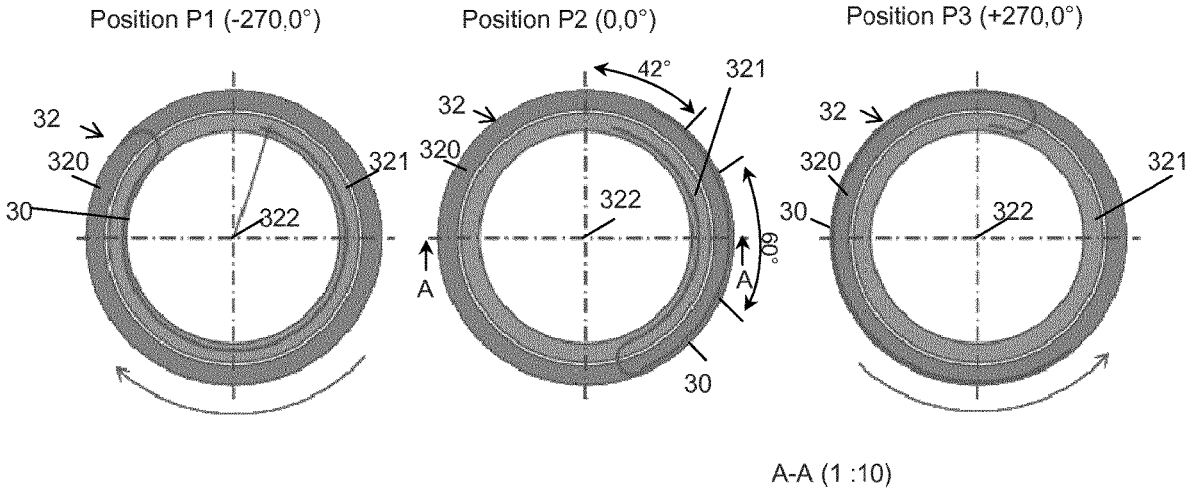
FIG. 8 is a top view of a cable twist showing 3 positions, according to one embodiment.

FIG. 8 is a top view of the connection zone in an embodiment where a cable twist 32 is used as an alternative to a rotary joint, according to three exemplary positions noted P1 (−270, 0), P2 (0,0), and P3 (+270,0). The cable twist 32 may comprise a first body 320 connected to the stationary support structure 5 and a second body 321 connected to the rotatable part 600, the bodies 320 and 321 being rotatable with respect to each other about the rotary joint axis 322.

In position P1, the position of the cable run 30 is moved of −270 degrees.

In position P2, the position of the cable run 30 is moved of 0 degrees (the cable is returned to the same position).

In position P3, the position of the cable run 30 is moved of +270 degrees.

Figure 9:
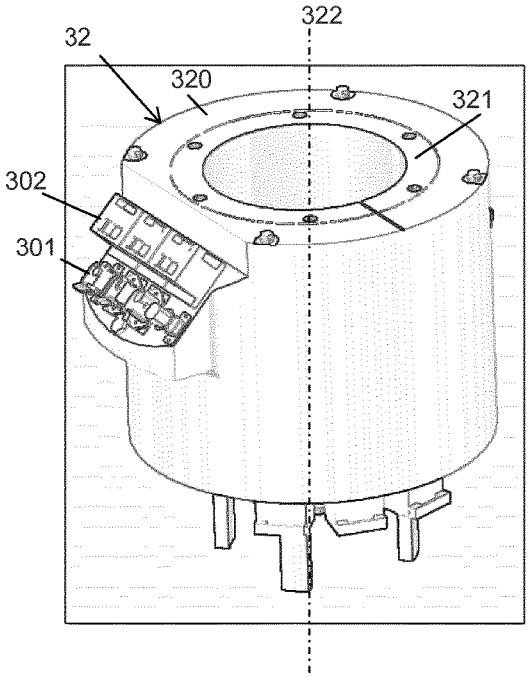
FIG. 9 is a perspective view of a rotary joint used as a connection component as an alternative to the cable twist of FIG. 8.

FIG. 9 is a view of an exemplary rotary joint 32 with two rotating bodies 320 and 321, showing the input 301/output 302 of the cable 30.

In some embodiment, the antennas 20 and 22 may be installed as high as possible to maximize their radio horizon. More generally the height of the antennas 20 and 22 above the support structure may be defined depending on the application of the invention, the height of the communication antenna 22 being preferably higher that the height of the directional antenna 20.

The invention is generally applicable for integration of an antenna arrangement upon any support structure.

Although not limited to such applications, the invention has particular advantages in applications where the support system 12 (e.g. ship) or the support structure 5 offers limited available space.

In an exemplary application of the antenna, the pole 40 can be surmounted with an omnidirectional naval communication Line-of-Sight antenna 20 extending beyond the Line-of-Sight (LoS) of the directional antenna 20, for example for Satellite Communication.

Figure 10:
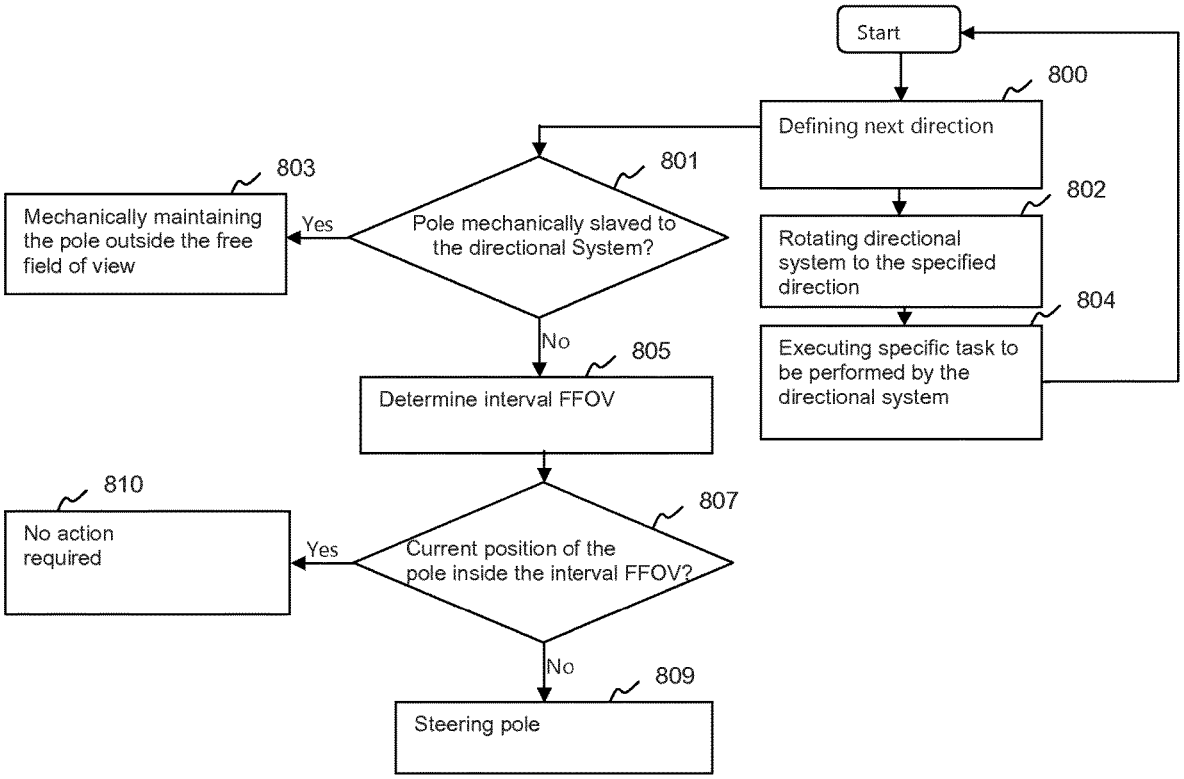
FIG. 10 is a flowchart depicting the process of rotating the pole assembly 4, according to an embodiment.

FIG. 10 is a flowchart depicting the process of rotating the pole assembly 4, according to an embodiment.

In block 800, the next direction (azimuth) to which the directional system 2 is to be pointing at a certain time is defined by the ship system.

In step 802, the directional system 2 is rotated to the specified direction.

In step 804, a specific task to be performed by the directional system 2 is executed. For example, in step 804, RF energy is transmitted or received by a radar or a communication system.

Further, in step 801, it is checked if the pole is mechanically slaved to the directional system 22. If so, in block 803, the pole 40 mechanically remains outside the free field of view of the directional system 2 and no further action is required.

Otherwise, if the pole 40 is not mechanically slaved to the directional system 22, in step 805 an interval FFOV (Free Field Of View) is determined with positions defining the free field of view of the directional antenna 22.

In step 807, it may be further determined if the current position of the pole 40 is inside the interval FFOV determined in step 805. The current position of the pole 40 may be determined by measurement or be known by the system from the previous action.

If the current position of the pole 40 is inside the interval FFOV, in step 809, the pole 40 may be steered to the mean value of the FFOV plus a predefined angle, such as 180 degrees, or to the nearest boundary value of the FFOV with respect to the current position of the pole.

Otherwise, if the current position of the pole 40 is outside the interval FFOV, no further action is needed (block 810).

Figure 11:
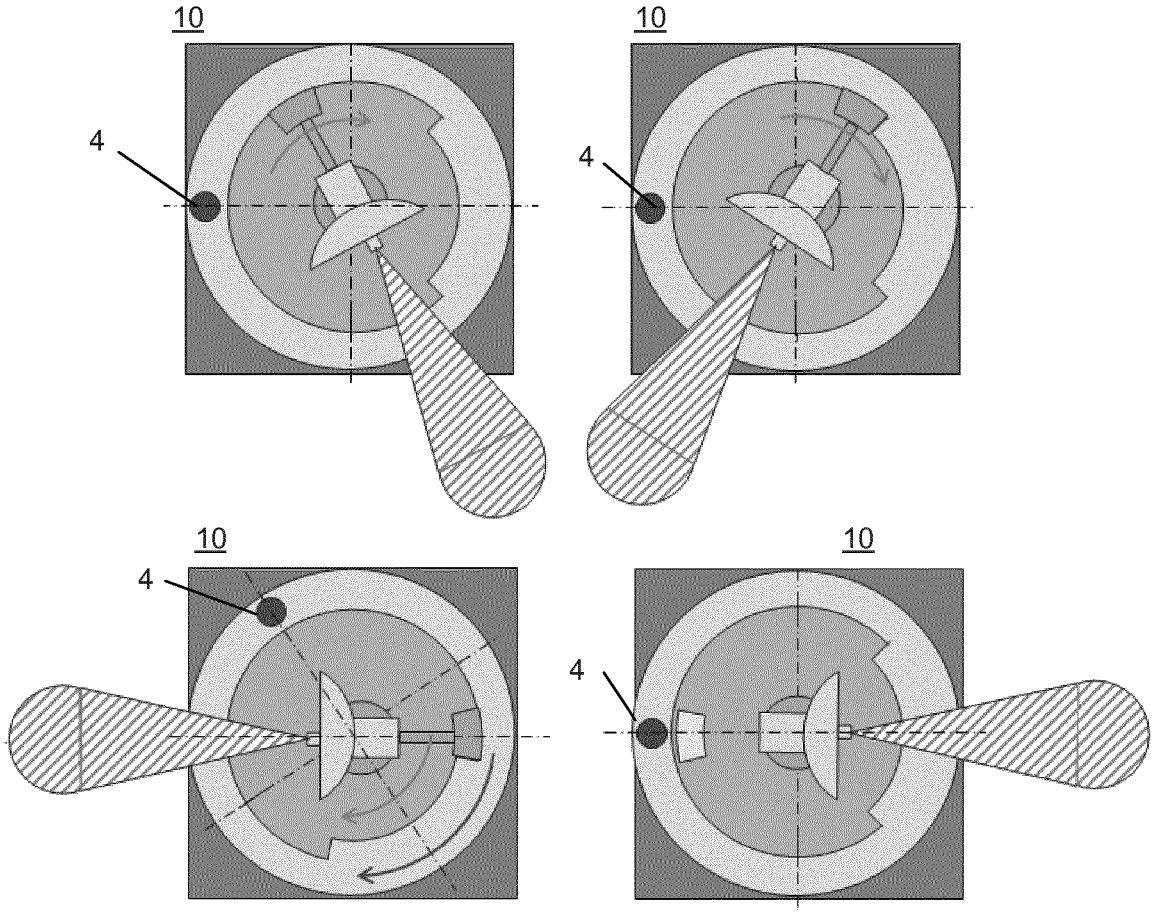
FIG. 11 is a top view of the antenna arrangement, in different positions when rotated in azimuth.
Figure 12:
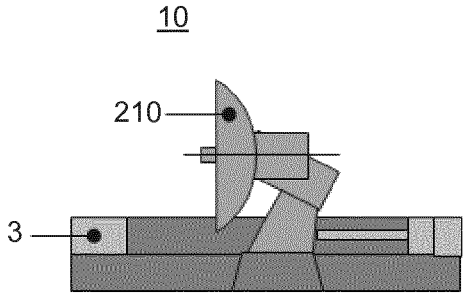
FIG. 12 shows a rotating layer driver for mechanically driving the rotating layer, according to an embodiment.

FIG. 11 shows a top view of the antenna arrangement, in different positions when rotated around axis 11. In one embodiment, the rotating layer 3 may be mechanically driven by a rotating layer driver such as the rotating layer director 210 depicted in FIG. 12. Alternatively, the mechanical driver may be replaced by one or more proximity sensors configured to enable electrical actuation (either ON (Left or Right) or OFF).

Embodiments of the present invention thus provide an integrated antenna arrangement in a space as compact as possible depending on the required equipments, with possible lightning protection. The arrangement is adapted to provide unobstructed field of view for the directional antenna 20, and of the communication antenna 22 by controlling the rotation of the rotating base 3 when such communication antenna 22 is mounted on the pole 40. The antenna arrangement 10 further ensures that the aperture of the directional antenna 20 is not blocked and that the electromagnetic interference between the antennas 20 and 22 does not occur. Accordingly, the performances of both antennas 20 and 22 can be optimized.

In an exemplary application of the invention to a support system 12 of ship type using a mast as a support structure 5 (Navy or shipyard application), the mast 5 may be bolted or welded to the ship 12, hooked up to the power supply, coolant system and/or data transmission and may be operational very quickly (in only two or three weeks), while conventional systems require one year for the installation, integration and tests. In such application, the antenna arrangement may be used as a surface surveillance radar for detecting and tracking small objects between the waves (including "asymmetric" threats such as unmanned air vehicles, fast inshore attack craft, gliders, dinghies, swimmers or mines), thereby contributing to situational awareness in littoral environments. The mast 5 forms a structurally self-supporting module for the integrated antenna arrangement 10. In embodiments in which a communication antenna 22 is used, although the communication antenna 22 and the directional antenna 20 are relatively close to each other, the operation of the antenna arrangement 10 is not affected by interference between the antennas 20 and 22. Further, unlike many conventional integrated antenna arrangements, it is not needed to switch one antenna 20 or 22 off before the other antenna can be used. The compactness of the antenna arrangement 10 makes it possible to concentrate the antenna arrangement equipments or components above or inside the mast 5, the outer surface of the mast being freed so that it can be used for other equipments such as surveillance sensors.

Another advantage of the integrated antenna arrangement according to embodiments of the invention is that it reduces costs of maintenance while the little maintenance that is required can be performed in the protected, sheltered environment of the support structure 5, without a need to wait for repairs until weather conditions are safe enough.

While embodiments of the invention have been illustrated by a description of various examples, and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative methods, and illustrative examples shown and described.

The invention claimed is:

1. An antenna arrangement comprising:

a directional antenna assembly, comprising a directional antenna mounted upon a stationary support structure through a connection base of the directional antenna, the directional antenna generally extending along a main vertical axis perpendicular to a plane defined by said stationary support structure; and a rotatable base rotatably mounted about said stationary support structure and a pole assembly, said pole assembly comprising a pole mounted on said rotatable base, said pole extending in the direction of said main axis, the rotatable base being a base different from the connection base of the directional antenna assembly, the rotatable base surrounding the connection base of the directional antenna assembly, said rotatable base being rotatable about the main axis, said rotatable base being configured to control the rotation of the pole assembly in azimuth, about the main axis, a rotation of said rotatable base actuating and controlling the rotation of the pole about the main axis so as to enable relocation of the pole outside the line-of-sight of the directional antenna, the upper end of the pole lying above the upper point of the directional antenna assembly.

2. The antenna arrangement of claim 1, wherein the pole is configured to rotate outside the field of view of directional antenna.

3. The antenna arrangement of claim 1, wherein said antenna arrangement further comprises a rotating control unit for controlling the rotation of the pole.

4. The antenna arrangement of claim 1, wherein the directional antenna is rotatable at least about a main axis, the rotation of the directional antenna about the main axis defining the azimuth rotation of the directional antenna.

5. The antenna arrangement of claim 1, wherein said antenna arrangement further comprises a communication antenna mounted on the pole.

6. The antenna arrangement of claim 5, wherein the communication antenna is selected in the group consisting of an omnidirectional antenna and a directional antenna.

7. The antenna arrangement of claim 5, wherein the communication antenna comprises a set of elementary antennas stacked in the direction of the main axis.

8. The antenna arrangement of claim 1, wherein the directional antenna assembly comprises a radome wherein the directional antenna is enclosed.

9. The antenna arrangement of claim 8, wherein the base of the radome is mounted upon the rotatable base.

10. The antenna arrangement of claim 8, wherein the base of the radome is surrounded by the rotatable base.

11. The antenna arrangement of claim 1, further comprising a lightning arrestor arranged on the pole.

12. The antenna arrangement of claim 11, wherein the antenna arrangement further comprises a communication antenna mounted on the pole and the lightning arrestor is arranged above the communication antenna.

13. An antenna system comprising:

the antenna arrangement of claim 1, wherein the support structure is mounted on a support system and the support structure is hollow.

14. The antenna system of claim 13, further comprising a connection component to connect the rotatable base to the support structure.

15. The antenna system of claim 14, wherein the connection component is a cable twist.

16. The antenna system of claim 15, wherein the connection component is a rotary joint.

17. The antenna arrangement of claim 1, wherein the directional antenna is rotatable.

18. The antenna arrangement of claim 17, wherein the rotatable base is mechanically slaved to the rotation of the directional antenna.

* * * * *